US006460722B2

(12) United States Patent
Lee

(10) Patent No.: US 6,460,722 B2
(45) Date of Patent: Oct. 8, 2002

(54) CONTAINER FOR KEEPING WINE BOTTLES IN A COOL CONDITION

(75) Inventor: Ching-Chang Lee, Taipei (TW)

(73) Assignee: Brothers Promotions, Inc., Taipei (TW)

( * ) Notice: Subject to any disclaimer, the term of this patent is extended or adjusted under 35 U.S.C. 154(b) by 1 day.

(21) Appl. No.: 09/812,614

(22) Filed: Mar. 20, 2001

(65) Prior Publication Data

US 2001/0054617 A1 Dec. 27, 2001

(30) Foreign Application Priority Data

Jun. 21, 2000 (TW) ..... 089210658

(51) Int. Cl.[7] ..... B65D 5/56

(52) U.S. Cl. ..... 220/592.16; 220/592.18; 220/23.88; 220/735; 220/737; 62/457.4

(58) Field of Search ..... 220/592.16, 592.18, 220/592.19, 592.23, 592.28, 23.88, 735, 737; 62/457.4

(56) References Cited

U.S. PATENT DOCUMENTS 991,715 A * 5/1911 Good
1,021,670 A * 3/1912 Garey
1,240,131 A * 3/1917 Gibbs
2,531,223 A * 11/1950 Kovacs et al.
3,709,235 A * 1/1973 Washburn et al. ..... 220/23.88
5,329,778 A * 7/1994 Padamsee ..... 220/592.16
5,975,336 A * 11/1999 Hart ..... 220/592.17
6,094,936 A * 8/2000 Miller ..... 62/417.4

* cited by examiner

*Primary Examiner*—Joseph M. Moy
(74) *Attorney, Agent, or Firm*—Webb Ziesenheim Logsdon Orkin & Hanson, P.C.

(57) ABSTRACT

A container includes a container body with an accommodating space including central and surrounding regions. A plurality of coolant vessels are retained detachably in the surrounding region by a plurality of retaining members against falling towards the central region. The vessels can be filled with coolant so as to keep the accommodating space, in which wine bottles are received, in a cool condition. A bottom wall of the container body is provided with a plurality of spacers so as to space the wine bottles from the bottom wall.

5 Claims, 4 Drawing Sheets

CONTAINER FOR KEEPING WINE BOTTLES IN A COOL CONDITION

BACKGROUND OF THE INVENTION

1. Field of the Invention

This invention relates to a container for wine bottles, more particularly to a container for keeping wine bottles in a cool condition.

2. Description of the Related Art

In a conventional method for keeping a wine bottle in a cool condition, a bucket is filled with ice cubes, and the bottle is then placed in the container. However, it is required to wrap the bottle in a towel for preventing dripping of water that condensed on the bottle, thereby resulting in inconvenience when taking the bottle out from the container.

SUMMARY OF THE INVENTION

The object of the present invention is to provide a container which can prevent wine bottles received therein from dripping when the bottles are taken out therefrom.

According to this invention, the container includes a container body which has a bottom wall with first inner and outer wall surfaces opposite to each other in an upright direction, and a surrounding wall with second inner and outer wall surfaces which extend respectively and upwardly from peripheries of the first inner and outer wall surfaces to confine an accommodation space, and which terminate at an upper surrounding edge portion that defines an opening for access into the accommodation space. The accommodating space includes a central region, and a surrounding region which surrounds and which extends radially and outwardly from the central region to the second inner wall surface. A plurality of coolant vessels are detachably disposed in the surrounding region and are angularly displaced from one another along the periphery of the first inner wall surface. Each vessel includes a rear major wall which is disposed to confront the second inner wall surface, a front major wall which is opposite to the rear major wall and which faces the central region, and two lateral side walls opposite to each other in a direction transverse to the upright direction. A plurality of retaining members are disposed on and extend radially and inwardly of the second inner wall surface toward the central region, and downwardly toward the first inner wall surface. Each retaining member is interposed between one of the lateral side walls of one of the vessels and an adjacent one of the lateral side walls of an adjacent one of the vessels such that two of the retaining members, which flank respectively the two lateral side walls of one of the vessels, retain said one of the vessels from falling toward the central region. Preferably, a plurality of spacers are disposed at the central region and on the first inner wall surface so as to space wine bottles, which are received in the accommodating space, from the first inner wall surface that is being wetted by the dripping water formed as a result of cohesion of water drops which condensed on the bottles.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
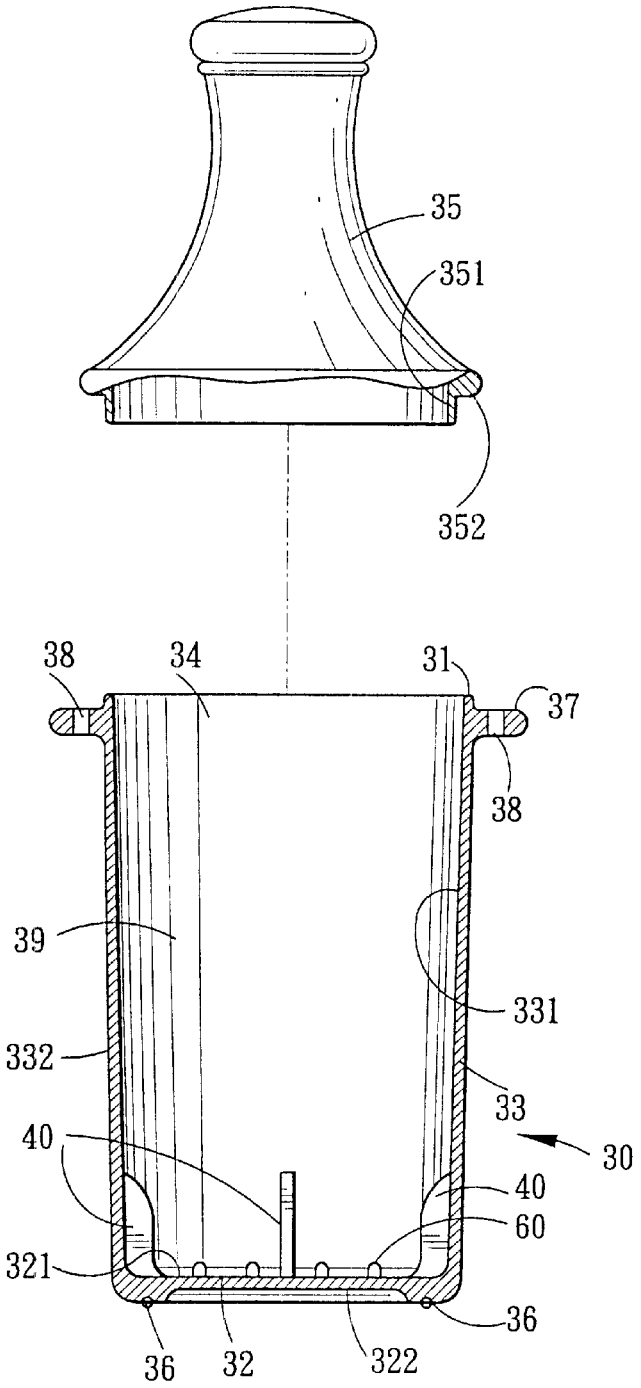
FIG. 1 is an exploded partly sectional view of a preferred embodiment of a container according to this invention.
Figure 2:
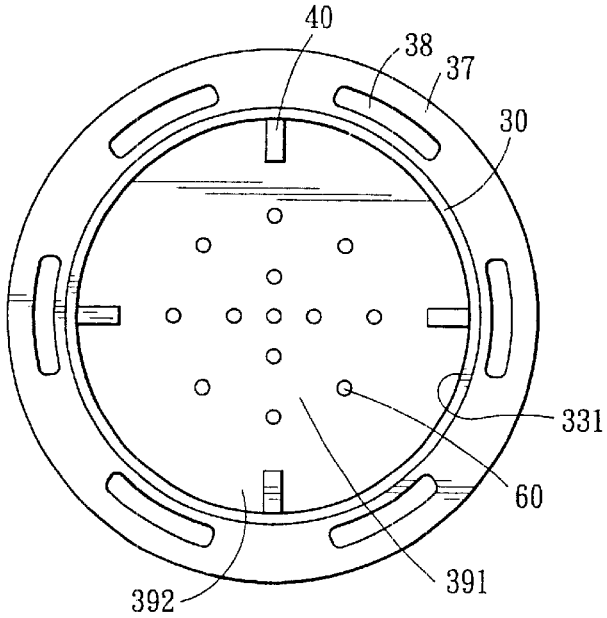
FIG. 2 is a top view of the preferred embodiment.
Figure 4:
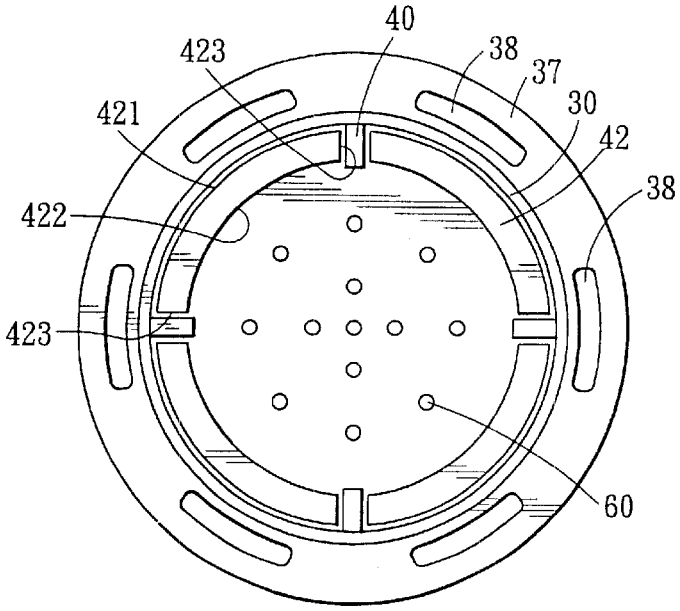
FIG. 4 is a top view of the preferred embodiment showing a plurality of coolant vessels mounted in a container body.

Referring to FIGS. 1, 2, and 4, the preferred embodiment of the container according to the present invention is shown to comprise a container body 30, a plurality of retaining members 40, a plurality of vessels 42, a plurality of spacers 60, and a lid member 35.

The container body 30 includes a bottom wall 32 with first inner and outer wall surfaces 321,322 opposite to each other in an upright direction, and a surrounding wall 33 with second inner and outer wall surfaces 331,332 which extend respectively and upwardly from peripheries of the first inner and outer wall surfaces 321,322 to confine an accommodation space 39, and which terminate at an upper surrounding edge portion 31 that defines an opening 34 for access into the accommodation space 39. As shown in FIG. 2, the accommodating space 39 includes a central region 391, and a surrounding region 392 which surrounds and which extends radially and outwardly from the central region 391 to the second inner wall surface 331. A plurality of slip preventing members 36 are disposed on the first outer wall surface 322. The lid member 35 has a peripheral edge portion 352, and an annular guiding portion 351 which has such a dimension as to permit insertion thereof into the opening 34 and to permit the peripheral edge portion 352 to rest on the upper surrounding edge portion 31 so as to close the opening 34.

Figure 3:
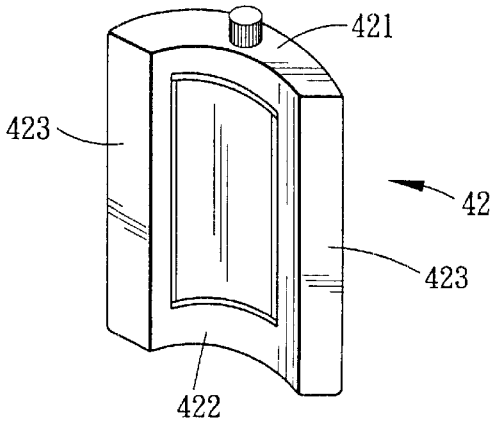
FIG. 3 is a perspective view of a coolant vessel of the container of the preferred embodiment.

Referring to FIG. 4, the coolant vessels 42 are adapted to be filled with coolant therein, are detachably disposed in the surrounding region 392, and are angularly displaced from one another along the periphery of the first inner wall surface 321. With reference to FIG. 3, each coolant vessel 42 is arcuate-shaped, and includes a rear major wall 421 which is disposed to confront the second inner wall surface 331, a front major wall 422 which is opposite to the rear major wall 421 and which faces the central region 391, and two lateral side walls 423 opposite to each other in a direction transverse to the upright direction.

The retaining members 40 are disposed on and extend radially and inwardly of the second inner wall surface 331 toward the central region 391, and downwardly toward the first inner wall surface 321 of the bottom wall 32. Each retaining member 40 is interposed between one of the lateral side walls 423 of one of the vessels 42, and an adjacent one of the lateral side walls 423 of an adjacent one of the vessels 42. As such, two of the retaining members 40, which flank respectively the two lateral side walls 423 of one vessel 42, retain the vessel 42 from falling toward the central region 391. Thus, the coolants received in the vessels 42 can keep the accommodating space 39 of the container body 30 in a cool condition, especially the central region 391 where wine bottles (not shown) are to be received therein.

The spacers 60, such as protrusions, are disposed at the central region 391 and on the first inner wall surface 321 so as to space the wine bottles from the first inner wall surface 321 which is being wetted by the dripping water formed as a result of cohesion of water drops that condensed on the bottles.

Figure 5:
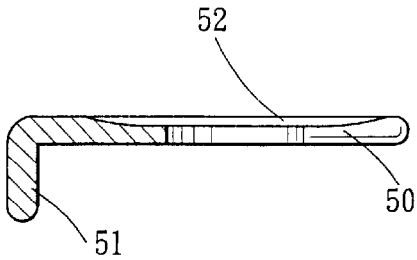
FIG. 5 is a sectional view showing a holder of the container of the preferred embodiment.
Figure 6:
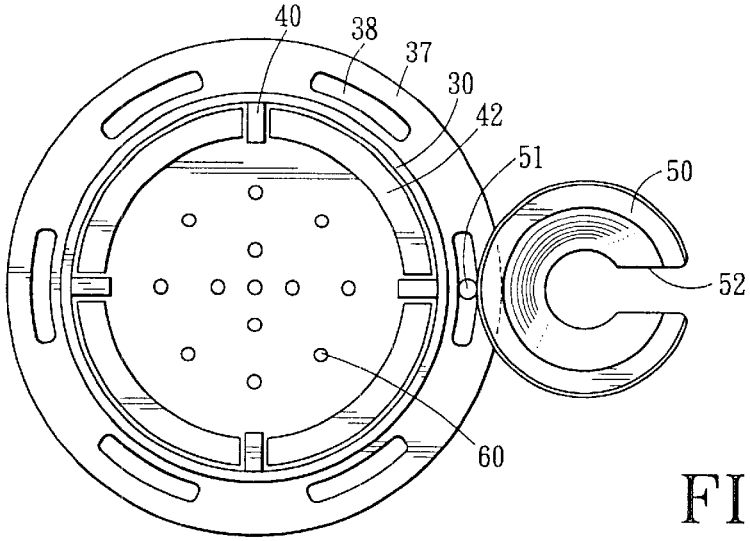
FIG. 6 is a top view of the preferred embodiment showing the holder when disposed on the container body.
Figure 7:
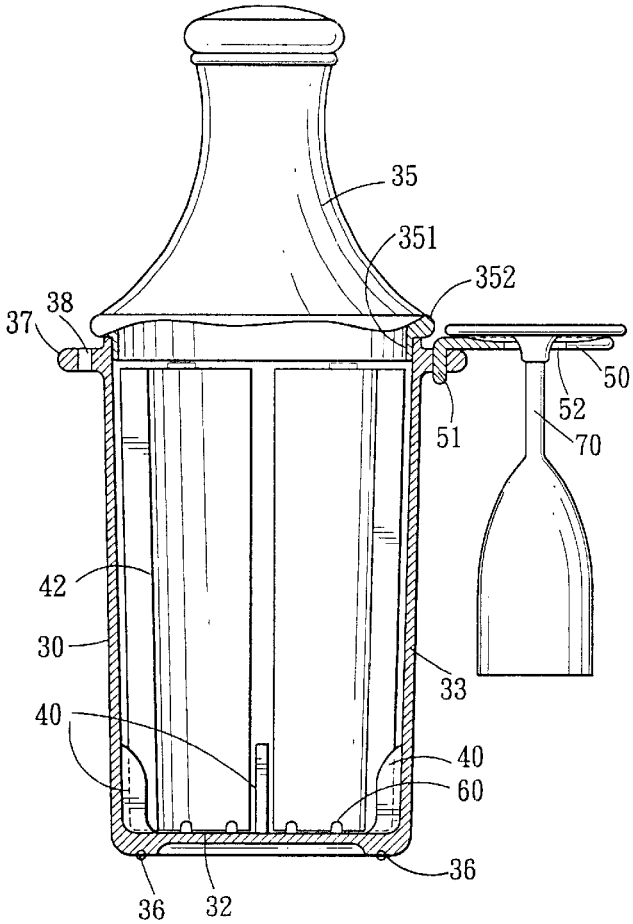
FIG. 7 is a partly sectional view of the preferred embodiment.

Preferably, an annular flange 37 is disposed around and extends radially and outwardly of the upper surrounding edge portion 31. The annular flange 37 has a plurality of anchored slots 38 which extend therethrough in the upright direction and which are angularly disposed from one another. A plurality of holders 50 are disposed to engage the anchored slots 38, respectively. With reference to FIGS. 5, 6, and 7, each holder 50 includes an anchoring end portion 51 which is disposed to detachably anchor the respective anchored slot 38, and a C-shaped holding end portion 52 which extends outwardly of the anchoring end portion 51 so as to be adapted to hold a wine glass 70.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A container for keeping wine bottles in a cool condition, comprising:

a container body including a bottom wall with first inner and outer wall surfaces opposite to each other in an upright direction, and a surrounding wall with second inner and outer wall surfaces extending respectively and upwardly from peripheries of said first inner and outer wall surfaces to confine an accommodation space, and terminating at an upper surrounding edge portion which defines an opening for access into said accommodation space, said accommodating space including a central region, and a surrounding region which surrounds and which extends radially and outwardly from said central region to said second inner wall surface;

a plurality of coolant vessels detachably disposed in said surrounding region and angularly displaced from one another along said periphery of said first inner wall surface, each of said coolant vessels including a rear major wall disposed to confront said second inner wall surface, a front major wall opposite to said rear major wall and facing said central region, and two lateral side walls opposite to each other in a direction transverse to the upright direction; and a plurality of retaining members disposed on and extending radially and inwardly of said second inner wall surface toward said central region, and downwardly toward said first inner wall surface, each of said retaining members being interposed between one of said lateral side walls of one of said vessels and an adjacent one of said lateral side walls of an adjacent one of said vessels such that two of said retaining members, which flank respectively said two lateral side walls of one of said vessels, retain said one of said vessels from falling toward said central region.

2. The container of claim 1, further comprising a plurality of spacers disposed at said central region and on said first inner wall surface so as to space the wine bottles from said first inner wall surface.

3. The container of claim 1, further comprising a lid member with a peripheral edge portion of such a dimension as to rest on said upper surrounding edge portion so as to close said opening.

4. The container of claim 1, further comprising an annular flange disposed around and extending radially and outwardly of said upper surrounding edge portion to serve as a rack for holding wine glass.

5. The container of claim 4, wherein said annular flange has at least one anchored slot extending therethrough in the upright direction, said container further comprising a holder including an anchoring end portion which is disposed to detachably anchor said anchored slot, and a holding end portion which extends outwardly of said anchoring end portion for holding the wine glass.

* * * * *